United States Patent [19]

Watanabe et al.

[11] Patent Number: 4,773,377

[45] Date of Patent: Sep. 27, 1988

[54] ENGINE AIR FUEL RATIO CONTROL SYSTEM

[75] Inventors: Tomomi Watanabe; Akira Takai; Katsumi Okazaki, all of Hiroshima, Japan

[73] Assignee: Mazda Motor Corporation, Hiroshima, Japan

[21] Appl. No.: 904,622

[22] Filed: Sep. 8, 1986

[30] Foreign Application Priority Data

Sep. 11, 1985 [JP] Japan ..... 60-201212

[51] Int. Cl.[4] ..... F02D 41/14

[52] U.S. Cl. ..... 123/489

[58] Field of Search ..... 123/440, 489, 589; 60/276

[56] References Cited

U.S. PATENT DOCUMENTS

| | | | |
|---|---|---|---|
| 4,089,313 | 5/1978 | Asano et al. | 123/440 |
| 4,163,433 | 8/1979 | Fujishiro | 123/440 |
| 4,173,952 | 11/1979 | Asano | 123/440 |
| 4,290,400 | 9/1981 | Pomerantz | 123/440 |
| 4,461,258 | 7/1984 | Becker et al. | 123/440 |

FOREIGN PATENT DOCUMENTS

| | | | |
|---|---|---|---|
| 136519 | 4/1985 | European Pat. Off. | 123/440 |
| 58-59321 | 4/1983 | Japan . | |
| 60-6036 | 1/1985 | Japan . | |

*Primary Examiner*—Andrew M. Dolinar

*Attorney, Agent, or Firm*—Fleit, Jacobson, Cohn & Price

[57] ABSTRACT

An engine fuel supply control system having an air fuel ratio detector which detects the concentration of oxygen content in the engine exhaust gas and providing an air fuel ratio signal representing the air fuel ratio of the engine intake mixture. A control unit is provided to compare the air fuel ratio signal with a reference signal representing a desired air fuel ratio and adjusting the air fuel ratio by a predetermined control factor so that the actual air fuel ratio becomes closer to the desired ratio. The amount of the predetermined control factor is smaller in the engine operating condition wherein the desired air fuel ratio is relatively lean than in the engine operating condition wherein the desired air fuel ratio is relatively rich.

12 Claims, 4 Drawing Sheets

| DESIRED AIR/FUEL | 10 | 15 | 18 | 20 | 22 | 25 |
|---|---|---|---|---|---|---|
| I FACTOR | 1.0 | 0.9 | 0.8 | 0.6 | 0.4 | 0.2 |
| P FACTOR | 10 | 9 | 8 | 6 | 4 | 2 |

| DESIRED AIR/FUEL | 10 | 15 | 18 | 20 | 22 | 25 |
|---|---|---|---|---|---|---|
| I FACTOR | 1.0 | 0.9 | 0.8 | 0.6 | 0.4 | 0.2 |
| P FACTOR | 10 | 9 | 8 | 6 | 4 | 2 |

ENGINE AIR FUEL RATIO CONTROL SYSTEM

BACKGROUND OF THE INVENTION

1. Field of the Invention

The present invention relates to an engine fuel control system and more particularly to an air fuel ratio control system for an internal combustion engine. More specifically, the present invention pertains to an engine fuel control system wherein the actual fuel air ratio is detected in terms of the concentration of a composition in the engine exhaust gas and the fuel supply is adjusted in accordance with the thus detected actual air fuel ratio to obtain a desired ratio.

2. Description of the Prior Art

In Japanese patent application No. 56-156940 filed on Oct. 3, 1981 and disclosed for public inspection on Apr. 8, 1983 under the disclosure number 58-59321, there is disclosed an engine fuel control system which has an air fuel ratio detector comprised of an oxygen concentration sensor located in the engine exhaust passage to detect the oxygen concentration in the exhaust gas. A feedback system is provided to transmit the detection signal from the detector to a control circuit wherein the signal is compared with a reference value which is provided for each specific engine operating condition to represent a desired air fuel ratio and fuel supply is adjusted in accordance with the difference between the actual air fuel ratio signal and the reference value. Japanese patent application No. 58-113778 filed on June 24, 1983 and disclosed on Jan. 12, 1985 for public inspection under the disclosure number 60-6036 discloses a similar fuel control system. The U.S. Pat. No. 4,089,313 is also referred to as showing an engine fuel control system having an air fuel ratio detector for detecting the concentration of a composition in the exhaust gas and a controller for producing a correction signal by comparing the signal from the air fuel ratio detector with a reference signal.

In these types of fuel control systems, it is desirable to determine the feedback control factor as small as possible to prevent or suppress huntings. However, where the feedback control factor is too small, the response of the control will become dissatisfactory particularly when the engine operating condition is changed from one state to another. In view of obtaining a satisfactory control response, the conventional fuel control systems have been such that the feedback control factor is of a relatively large value so that a desired air fuel ratio is quickly reached when the engine operating condition is changed.

It should however be noted that recent engine fuel control systems are such that an air fuel mixture leaner than stoichiometric ratio is usually established for normal operations and the mixture is enriched for specific engine operating conditions such as an acceleration and a high power output operating region. In case where the engine operating condition is changed from a high power output region requiring a relatively rich mixture to a normal operating condition wherein a relatively lean mixture is provided, there is a high possibility that the mixture becomes excessively lean possibly causing misfire and/or output torque fluctuations due to possible hunting if the feedback control factor is of a relatively large value. To the contrary, in case where the engine operating condition is changed from a normal operating condition to a high output power region, it is desirable to establish a relatively rich mixture for the high power operation. In the conventional fuel control systems, however, it has been impossible to meet the requirements in both conditions.

SUMMARY OF THE INVENTION

It is therefore an object of the present invention to provide an engine fuel control system wherein possibilties of misfire and output torque fluctuations can be avoided without having an adverse effect on the response of the control.

Another object of the present invention is to provide an engine fuel control system in which an air fuel mixture leaner than the stoichiometric ratio is provided for normal engine operation but possibility of the mixture becoming excessibly lean can be avoided when the engine operating condition is changed from a condition requiring a relatively rich mixture to the normal engine operating condition requiring the leaner mixture.

A further object of the present invention is to provide an engine fuel control system in which an air fuel mixture leaner than the stoichiometric ratio is provided for normal engine operation but possibility of misfire and output torque fluctuations can be avoided even in a transient period.

According to the present invention, the above and other objects can be accomplished by a fuel supply control system for an internal combustion engine comprising air fuel ratio detecting means provided in engine exhaust passage means for detecting concentration of a component in engine exhaust gas and producing an air fuel ratio signal, engine operating condition detecting means for detecting engine operating condition and producing an engine operating condition signal, air fuel ratio reference means responsive to said engine operating condition singal for producing a reference signal representing a desired air fuel ratio for the engine operating condition, comparator means for comparing said air fuel ratio signal with said reference signal and producing a difference signal corresponding to a difference between the air fuel ratio signal and the reference signal, feedback control means for receiving the difference signal to adjust based on the difference signal by a predetermined amount a factor which affect on the air fuel ratio of a mixture supplied to the engine so that said air fuel ratio becomes closer to said desired air fuel ratio, means for detecting an engine operating condition wherein a lean mixture is supplied to the engine and decreasing said predetermined amount when such engine operating condition is detected.

According to the features of the present invention, the feedback control factor, that is, the predetermined amount by which the factor which affects on the air fuel ratio of the mixture is adjusted based on the difference signal is decreased when the engine is in an operating condition wherein a relatively lean mixture is to be supplied, so that it is possible to avoid huntings when the engine operating condition is changed from a region wherein a relatively rich mixture is required to a region wherein a relatively lean mixture is required. When the engine operating condition is changed in the opposite direction, however, a satisfactory response rate is obtained since the feedback control factor is of a relatively large value.

The above and other objects and features of the present invention will become apparent from the following descriptions of a preferred embodiment taking reference to the accompanying drawings.

DESCRIPTION OF THE PREFERRED EMBODIMENT

Figure 1:
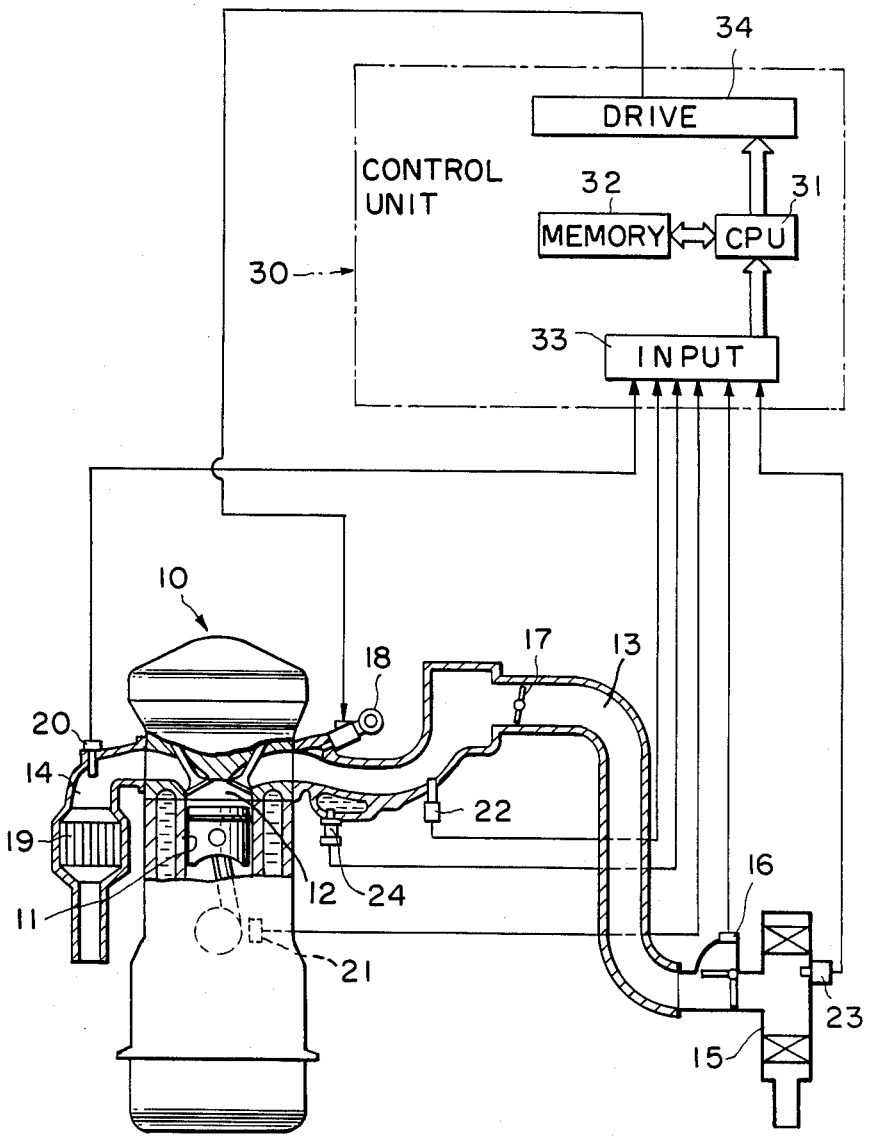
FIG. 1 is a diagrammatical view of an engine having a fuel control system in accordance with one embodiment of the present invention.

Referring to the drawings, particularly to FIG. 1, there is shown an engine 10 including a cylinder 11 in which a combustion chamber 12 is defined. An intake passage 13 is provided to communicate with the combustion chamber 12. An exhaust passage 14 leads from the combustion chamber 12 for exhausting the engine combustion gas. The intake passage 13 is provided at an upstream end with an air-cleaner 5, and an air flowmeter 16 is provided in the intake passage downstream the air-cleaner 15. Further downstream side, the intake passage 13 is provided in this order with a throttle valve 17 and a fuel injector 18. In the exhaust passage 14, there is provided an exhaust gas purification device 19 and an air fuel ratio detector 20 which is located upstream the exhaust gas purification device 19. The engine 10 further has an engine speed detector 21, an intake pressure detector 22, an intake air temperature detector 23 and an engine cooling water temperature detector 24.

Figure 2:
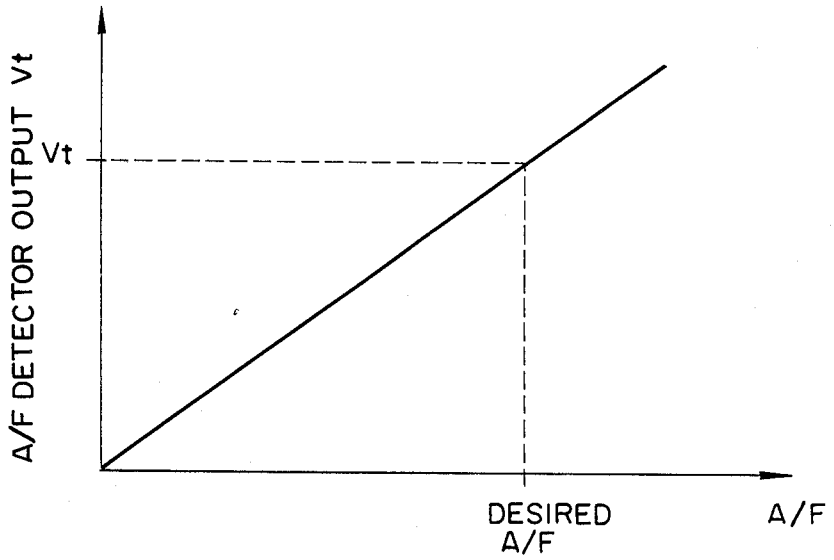
FIG. 2 is a diagram showing the output of the oxygen concentration detector.

The air fuel ratio detector 20 is of a type that detects the concentration of oxygen in the exhaust gas and produces an output corresponding to the air fuel ratio as shown in FIG. 2. For details of the detector 20, reference may be made to the Japanese patent disclosure No. 52-72286. The output of the detector 20 is connected with a control unit 30 which may be constituted by a microprocessor having a central power unit 31, a memory 32, an input circuit 33 and a driving circuit 34. The air fuel ratio signal from the detector 20 is introduced into the control unit 30 at the input circuit 33. The signals from the detectors 16, 21, 22, 23 and 24 are also introduced into the input circuit 33 of the control unit 30.

Figures 3, 3A:
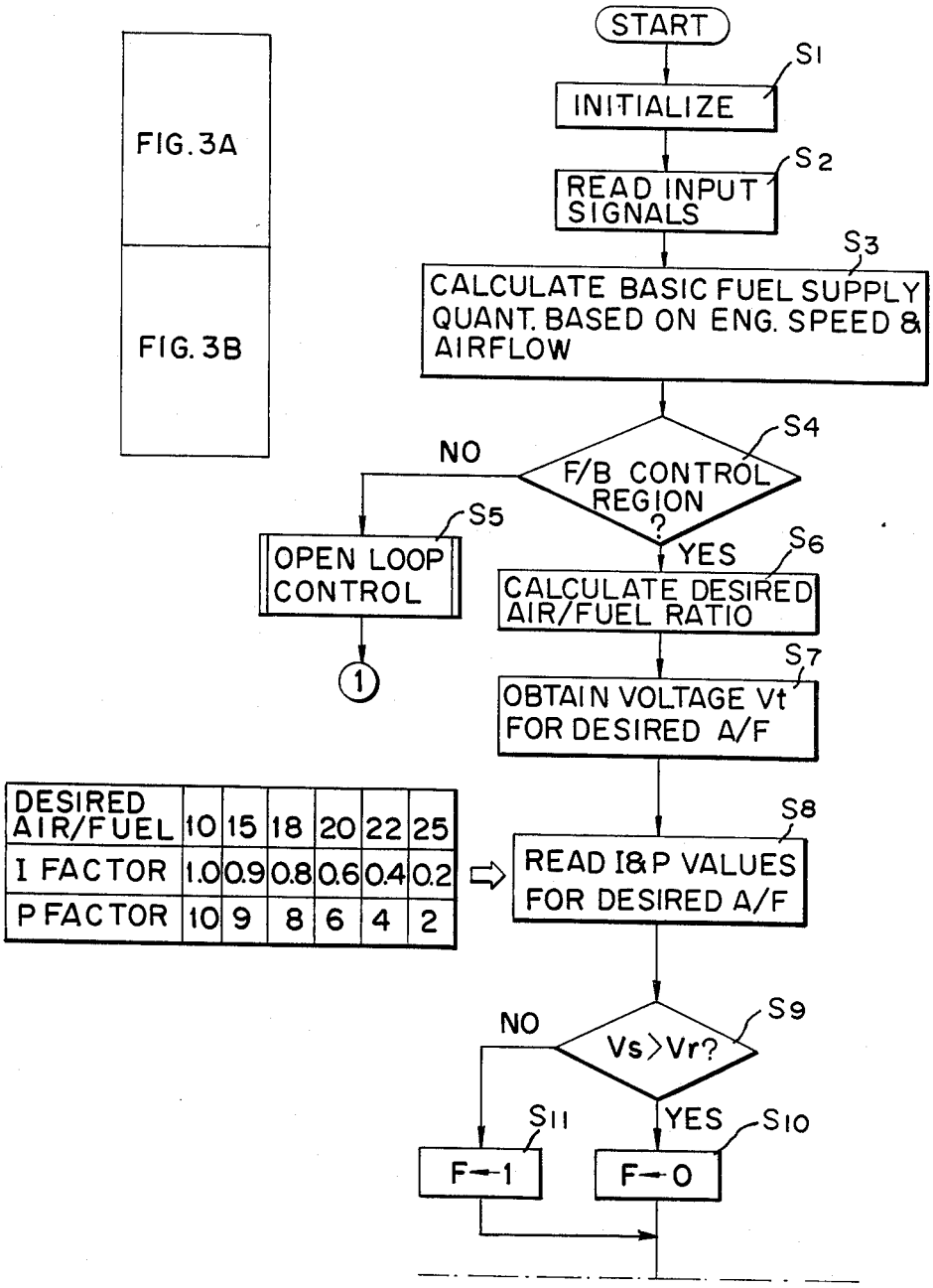
FIGS. 3, 3A and 3B are a program flow chart showing the operation of the control unit; and, FIG. 4 is a diagram showing the feedback control factor.
Figure 3B:
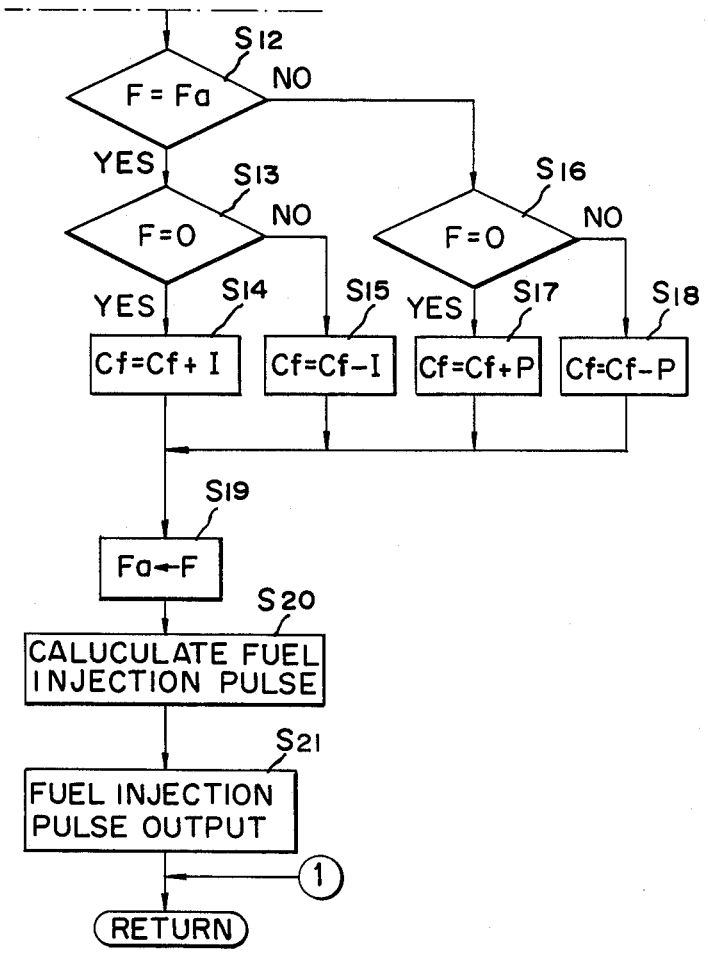

The control unit 30 functions to provide a desired air fuel ratio suitable for the actual engine operating condition and determine the fuel supply quantity based on the comparison between the output from the detector 20 and the desired air fuel ratio. The output of the control unit 30 is applied from the driving circuit 34 to the fuel injector 18. Referring to FIGS. 3, 3A and 3B, there is shown the operation of the control unit 30. In operation, the unit 30 is at first initialized at the step $S_1$ and the signals from the detectors 16 and 20 through 24 are read in the step $S_2$. Then, a basic fuel quantity pulse duration is calculated in the step $S_3$ based on the signal from the air flowmeter 16 and the signal from the engine speed detector 21. The procedure then proceeds to the step $S_4$ wherein judgement is made as to whether the engine cooling water temperature and the engine operating condition are suitable for the feedback fuel control. If the result of the judgement is NO, the procedure goes to the step $S_5$ to carry out an open control wherein the quantity of fuel supply is determined in accordance with the basic fuel supply quantity pulse duration $T_p$.

In case where the result of the judgement is YES, the step $S_6$ is carried out to calculate the desired air fuel ratio for the actual engine operating condition. In order to determine the desired air fuel ratio, the memory 32 stores values for the desired air fuel ratio for various engine operating conditions which can be represented by the engine speed and the basic fuel supply quantity. The control unit 30 then reads one of the stored values in accordance with the signals from the engine speed detector 21 and the basic fuel suppply quantity. The step $S_7$ is then carried out to obtain a reference voltage $V_t$ corresponding to the desired air fuel ratio in accordance with the output characteristics of the air fuel ratio detector 20 as shown in FIG. 2.

Figure 4:
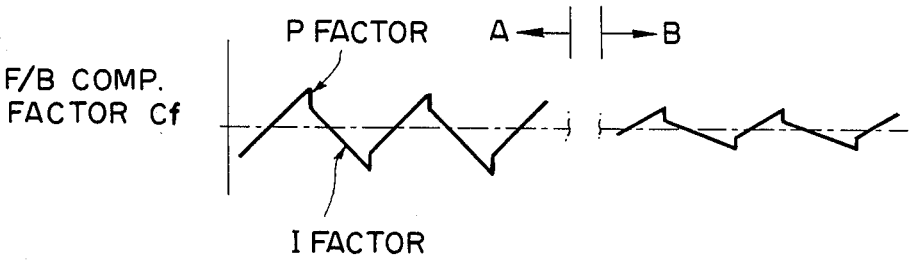

The step $S_8$ is then carried out to obtain an integral control factor I and a proportional control factor P which are determined in advance and stored in the memory 32 in the form of a map as shown in FIG. 3A. In the step $S_9$, a judgement is made as to whether the output signal $V_s$ from the air fuel ratio detector 20 is larger than the voltage $V_t$ corresponding to the desired air fuel ratio. If the value $V_s$ is larger than the value $V_t$, the flag F is set to 0 in the step $S_{10}$, but if the value $V_s$ is smaller than the value $V_t$, the flag F is set to 1 in the step $S_{11}$. In the succeeding step $S_{12}$, a judgement is made as to whether the flag position F is the same as the position $F_a$ in the preceeding cycle. If the result of the judgement is YES, it is interpreted that the feedback compensation factor did not cross the average value $C_o$ as shown in FIG. 4 and a further judgement is made in the step $S_{13}$ as to whether the flag position is 0. If the result of the judgement in the step $S_{13}$ is YES, a feedback compensation factor $C_f$ is provided in the step $S_{14}$ by adding the value of the integrating control factor I to the feedback compensation factor $C_f$ in the previous cycle. If the result of the judgement in the step $S_{13}$ is NO, a feedback compensation factor is provided by subtracting the value of the integrating control factor I from the feedback compensating factor $C_f$ in the previous cycle. Thus, the adjustment of the feedback compensation factor is made by adding or subtracting the integral control factor I.

In case where the result of the judgement in the step $S_{12}$ is NO, it is judged that the feedback compensation factor has crossed the average value $C_o$ and a further judgement is made in the step $S_{16}$ as to whether the flag position is 0. If the result of the judgement in the step $S_{16}$ is YES, a feedback compensating factor $C_f$ is provided in the step $S_{17}$ by adding the proportional control factor P to the feedback compensating factor $C_f$ in the preceeding cycle. If the result of the judgement in the step $S_{16}$ is NO, a feedback compensating factor is provided in the step $S_{18}$ by subtracting the the proportional control factor P from the feedback compensating factor $C_f$ in the preceeding cycle. Thus, the conpensation factor is adjusted by adding or subtracting the proportional control factor P when it is judged that the compensation factor has crossed the average value. With the aforementioned control, the voltage signal representing the actual air fuel ratio is compared with the reference voltage signal representing the desired air fuel ratio and a judgement is made as to whether the actual air fuel ratio is leaner than the desired value. In case where it is judged that the actual air fuel ratio is leaner than the desired value, the feedback compensation factor $C_f$ is increased to thereby increase the fuel supply. If it is judged that the actual air fuel ratio is richer than the desired value, the feedback compensation factor $C_f$ is decreased to thereby decrease the fuel supply. It should further be noted that such adjustment of the feedback compansation factor $C_f$ is made by using the integrating control factor I when the leaner condition or the richer condition is continued but by using the proportional control factor P when the air fuel ratio is changed from the leaner condition to the richer condition or vice versa.

Thereafter, the previous cycle flag position $F_a$ is substituted in the step $S_{19}$ by the flag position in the step $S_{10}$ or $S_{11}$ and the fuel supply quantity is determined in terms of the fuel injection pulse duration in the step $S_{20}$ based on the basic fuel supply quantity pulse duration and the feedback compensation factor $C_f$. The output pulse is then applied to the fuel injector 18 in the step $S_{21}$.

FIG. 4 shows changes in the feedback compensation factor $C_f$ under an engine operating condition where a relatively rich mixture is desired and another engine operating condition where a relatively lean mixture is desired. As shown, the factor $C_f$ cyclically changes about an average value $C_o$ and therefore the fuel supply quantity changes cyclically about the desired value. The changes in the factor $C_f$ under a condition where a relatively rich mixture is to be supplied are shown in the region A, whereas the changes under a condition where a relatively lean mixture is to be supplied are shown in the region B. It will be noted in the map shown in FIG. 3 that the factors P and I decrease as the air fuel ratio increases or as the mixture becomes leaner so that the amplitude of the changes of the compensation factor $C_f$ becomes smaller in the region B than in the region A. It is therefore possible to make the fluctuations of the air fuel ratio smaller in the region B than in the region A. Consequently, it is possible to prevent the air fuel mixture from becoming excessively lean as the result of the hunting when the engine is being operated with a relatively lean mixture.

In the embodiment as described, both the values P and I are decreased as the air fuel ratio increases. It should however be noted that only one of the values P and I may be changed to obtain a similar result. Further, the values may not necessarily be changed continuously as shown in FIG. 3, but the changes may be in a very small numberof steps. For example, the value P or I may be the same for the air fuel ratio of 10 through 18 and the value may be decreased for the air fuel ratio of 20 through 25. It should further be noted that instead of controlling the fuel supply quantity as in the embodiment desribed, an air supply may be controlled to obtain the desired air fuel ratio. For example, in an engine having a carburetor, a bypass air passage may be provided to bypass the throttle valve and air flow through the bypass passage may be controlled in accordance with the feedback compensation factor.

The invention has thus been shown and described with reference to a specific embodiment, however, it should be noted that the invention is in no way limited to the details of the illustrated structures but changes and modifications may be made without departing from the scope of the appended claims.

We claim:

1. A fuel supply control system for an internal combustion engine comprising air fuel ratio detecting means provided in engine exhaust passage means for detecting concentration of a component in engine exhaust gas and producing an air fuel ratio signal, engine operating condition detecting means for detecting engine operating condition and producing an engine operating condition signal, air fuel ratio reference means having a plurality of predetermined values of air fuel ratio including at least one value leaner than a stoichiometric value and responsive to said engine operating condition signal for producing a reference signal representing one of said predetermined values of air fuel ratio which is most desirable for the engine operating condition, comparator means for comparing said air fuel ratio signal with said reference signal and producing a difference signal corresponding to a difference between the air fuel ratio signal and the reference signal, feedback control means for receiving the difference signal to adjust based on the difference signal by a predetermined amount a factor which affects the air fuel ratio of a mixture supplied to the engine so that said air fuel ratio becomes closer to said most desirable air fuel ratio, means for changing said predetermined amount in accordance with said reference signal from the air fuel ratio reference means so that said predetermined amount is smaller for a value of the reference signal corresponding to a leaner value of the air fuel ratio.

2. A fuel supply control system in accordance with claim 1 in which said feedback control means includes means for determining a basic fuel supply quantity based on an engine intake air flow and compensating the basic fuel supply quantity in accordance with said difference signal.

3. A fuel supply system in accordance with claim 1 in which said air fuel ratio detecting means is means for detecting oxygen concentration and producing an output which changes continuously in response to a change in the oxygen concentration.

4. A fuel supply system in accordance with claim 1 in which said feedback control means includes means for providing a first control factor which is adapted to be used to adjust the feedback compensation factor when the compensation factor has changed from one of leaner and richer conditions to the other, and a second control factor which is adapted to be used to adjust the compensation factor when the compensation factor is maintained in one of the leaner and richer conditions.

5. A fuel supply system in accordance with claim 1 in which the last mentioned means includes memory means storing values of said predetermined amount for various engine operating conditions.

6. A fuel supply system in accordance with claim 4 in which the last mentioned means includes memory means storing values of said first and second control factor for various engine operating conditions.

7. A fuel supply control system in accordance with claim 1 in which said predetermined amount is provided for each value of the air fuel ratio.

8. A fuel supply control system in accordance with claim 1 in which said air fuel ratio reference means has a value of air fuel ratio corresponding to the stoichiometric value and at least one value richer than the stoichiometric value, said predetermined amount corresponding to the air fuel ratio corresponding to the stoichiometric value being larger than the predetermined amount corresponding to the leaner air fuel ratio and smaller than the predetermined amount corresponding to the richer air fuel ratio.

9. A fuel supply control system for an internal combustion engine comprising air fuel ratio detecting means provided in engine exhaust passage means for detecting concentration of a component in engine exhaust gas and producing an air fuel ratio signal, engine operating condition detecting means for detecting engine operating condition and producing an engine operating condition signal, air fuel ratio reference means having a plurality of predetermined values of air fuel ratio including at least one value leaner that a stoichiometric value and responsive to said engine operating condition signal for producing a reference signal representing one of said predetermined values of air fuel ratio which is most desirable for the engine operating condition, comparator means for comparing said air fuel ratio signal with said reference signal and producing a difference signal corresponding to a difference between the air fuel ratio signal and the reference signal, feedback control means for receiving the difference signal to adjust based on the difference signal by a feedback factor a basic fuel supply quantity so that said air fuel ratio becomes closer to said most desirable air fuel ratio, means for changing said feedback factor in accordance with said reference signal from the air fuel ratio reference so that said feedback factor is smaller for a value of reference signal corresponding to a leaner value of the air fuel ratio.

10. A fuel supply control system in accordance with claim 9 in which said feedback factor is provided for each value of the air fuel ratio.

11. A fuel supply control system in accordance with claim 9 in which said air fuel ratio reference means has a value of air fuel ratio corresponding to the stoichiometric value and at least one value richer than the stoichiometric value, said feedback factor corresponding to the air fuel ratio corresponding to the stoichiometric value being larger than the feedback factor corresponding to the leaner air fuel ratio and smaller than the feedback factor corresponding to the richer air fuel ratio.

12. A fuel supply system in accordance with claim 10 in which said feedback control means includes means for providing a first control factor which is adapted to be used to adjust the feedback factor when the feedback factor has changed from one of leaner and richer conditions to the other, and a second control factor which is adapted to be used to adjust the feedback factor when the feedback factor is maintained in one of the leaner and richer conditions.

* * * * *